United States Patent [19]

Hoffmann

[11] Patent Number: 4,553,270

[45] Date of Patent: Nov. 19, 1985

[54] PROTECTIVE HELMET WITH SECURING COLLAR

[76] Inventor: Hanspeter Hoffmann, Postfach 259, F1- 9595 Triesen, Fürstentum, Liechtenstein

[21] Appl. No.: 462,894

[22] Filed: Feb. 1, 1983

[30] Foreign Application Priority Data

Apr. 26, 1982 [CH] Switzerland ..... 2542/82

[51] Int. Cl.[4] ..... A42B 3/02

[52] U.S. Cl. ..... 2/421; 2/424; 2/6

[58] Field of Search ..... 2/421, 410, 424, 425, 2/6, 10, 415

[56] References Cited

U.S. PATENT DOCUMENTS

| | | | |
|---|---|---|---|
| 2,861,272 | 11/1958 | Stuart | 2/6 |
| 3,897,597 | 8/1975 | Kasper | 2/10 X |
| 4,290,150 | 9/1981 | Berthelot | 2/421 |
| 4,291,418 | 9/1981 | Zeisler | 2/410 |

FOREIGN PATENT DOCUMENTS

| | | | |
|---|---|---|---|
| 1185929 | 1/1965 | Fed. Rep. of Germany | 2/424 |
| 2846636 | 10/1978 | Fed. Rep. of Germany . | |
| 2853260 | 1/1982 | Fed. Rep. of Germany . | |
| 3229430 | 3/1983 | Fed. Rep. of Germany | 2/421 |
| 3143796 | 5/1983 | Fed. Rep. of Germany | 2/410 |
| 2430736 | 2/1980 | France . | |
| 7119890 | 1/1983 | France . | |
| 8300605 | 3/1983 | World Intel. Prop. Org. . | |

*Primary Examiner*—Peter Nerbun

*Attorney, Agent, or Firm*—Ladas & Parry

[57] ABSTRACT

The protective helmet (FIG. 1) is provided in its lower part with a collar (C) formed advantageously by two segments ($C_1$ and $C_2$) movable with respect to each other slidably, in opposite directions along parallel horizontal guides (54–55) provided in an annular tapered crown ($A_1$). Said shaped sectors terminate at their ends with two pairs of toothed racks (25–27 and 30–31), the elements of each pair being diametrically opposite with respect to their related actuating pinions (34–35) to achieve the simultaneous rectilinear movements in directions opposite to said segments to engage and disengage them with the jaw and head of the user. Segments ($C_1$ and $C_2$) are secured to body (A) of the helmet by guide elements (24,28,50) extending correspondingly and provided at their ends with blocking or stop means (60–64,51–65) which retain segments ($C_1$–$C_2$) in their retracted positions.

8 Claims, 10 Drawing Figures

FIG. 2
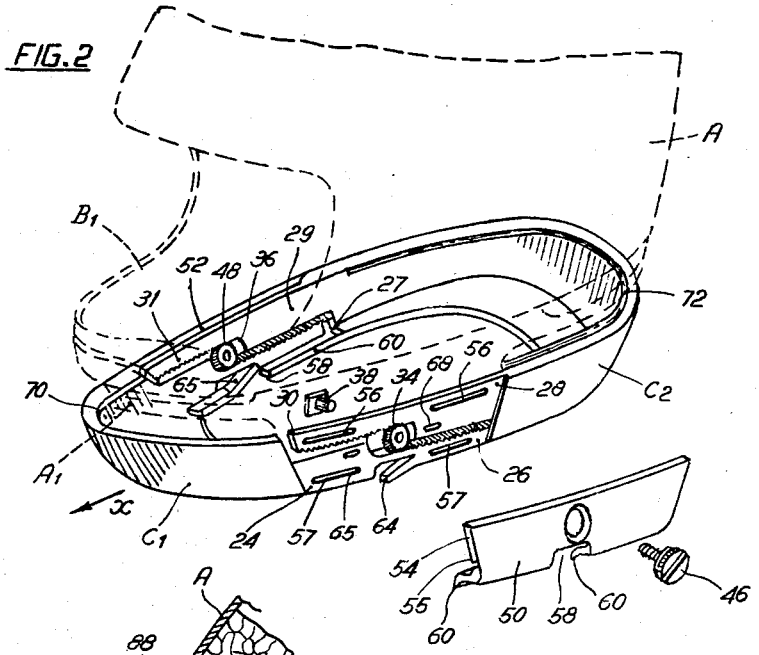
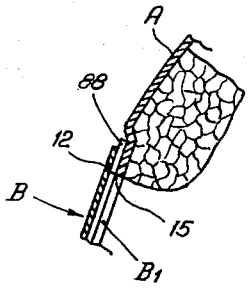
FIG. 7
FIG. 6
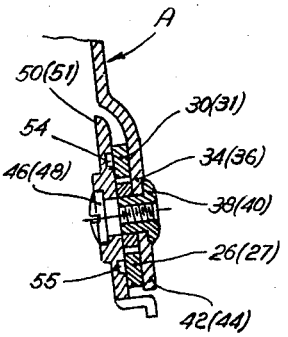
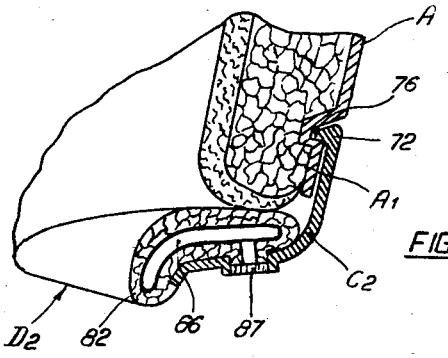
FIG. 5

PROTECTIVE HELMET WITH SECURING COLLAR

This invention relates to a protective helmet with retaining collar adapted in particular but not exclusively for sports use, for example, sking, motorcycling, automobile racing etc. The helmet, when worn is retained on the user's head securely and firmly while allowing complete freedom of movement to the user.

The known types of integral protective helmets are secured to the wearer's head by belts or chin straps, which are not comfortable and do not satisfy use requirements. It has been attempted to secure the helmet to the user's head by providing its bottom opening with devices or collar apt to engage the wearer's the chin or neck. These arrangements are evidenced by FR-PS 7733639, DE PS 2853260, and U.S. Pat. No. 4,291,418. However the helmets of known type considered in these prior patents and other; while satisfying on the one hand such use requirements, on the other hand they have certain drawbacks which limit their practical use; for example, the helmets cannot withstand stresses and their internal aeration and ventilation is not satisfactory.

This invention proposes to provide an integral helmet of the type specified, but which may be easily worn and firmly secured to the wearer's head with simple, quick and practical operations, thereby to afford protection also to the head, in addition to the jaw. Moreover, and in cases of emergency, the helmet according to this invention can be easily and quickly removed from the wearer's head, with considerable advantages for a wounded wearer.

A further object of the invention is to provide an integral helmet which, owing to its adaptability to the jaw and head of the wearer permits a constant and rational internal ventilation, thus avoiding fogging of the vizor in addition to facilitating breathing of the wearer, thanks also to the continuous renewal of the air inside the helmet.

The integral helmet according to this invention is provided with a collar which may be opened and engaged with the user's neck; it is characterized by at least one shaped segment in the mid part of which the wearer's jaw fits; the segment is provided at its extremities with elements which slide in rectilinear guides, situated in lateral opposite positions on the helmet body, while locking devices are provided in said shaped segment to retain the latter in closed position in order to secure the helmet movably to the wearer's head.

According to a first embodiment of the invention, the bottom opening of the helmet is provided with a tapered crown gear which houses at least in part the shaped segment and which has, in opposite lateral positions, horizontal guides to retain and guide slidably the extremities of the shaped segment whose ends are fitted with toothed racks or similar devices apt to engage operatably with rotatable actuating means, operation of which causes horizontal shifting of said shaped segment with respect to the helmet body.

In a variant of the embodiment of the helmet according to the invention, the ends of the shaped segment are connected to the helmet body by pairs of multiple hinges apt to permit horizontal movements of said shaped segment.

In order to ensure satisfactory engagement of the shaped elements with the jaw and head of the wearer, the mid grooved parts of said shaped segments are shaped so as to retain the elastic padding which engage with and adhere to the wearer's head or jaw, to secure the helmet firmly.

The invention will now be described in conjunction with the annexed drawings which illustrate, by way of example, but not limitedly, some preferred forms of embodiment of a helmet with securing collar according to the invention.

In the drawings:

FIG. 2 is an exploded perspective view of the collar in the helmet of FIG. 1.

FIGS. 4 and 5 are vertical sections, also on a larger scale, in the position of the parts of front collar segments (FIG. 4) and rear segment (FIG. 5)

FIG. 6 is a vertical section similar to FIGS. 4 and 5 showing one of the control elements for the two shaped segments FIG. 7 is a fragmentary vertical section of a variant of the helmet vizor FIG. 8, similar to FIG. 2 is a perspective view of a variant of embodiment of the helmet

Figure 10:
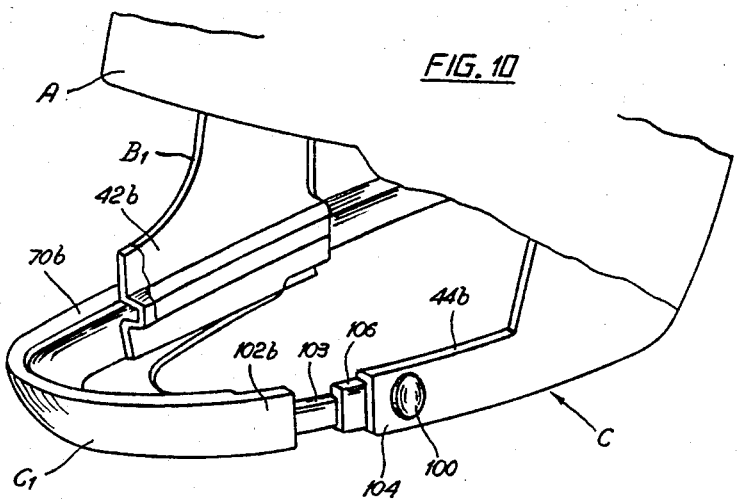

FIG. 10, also similar to FIG. 2, is a further perspective view of a further variant of embodiment of the helmet.

Figure 1:
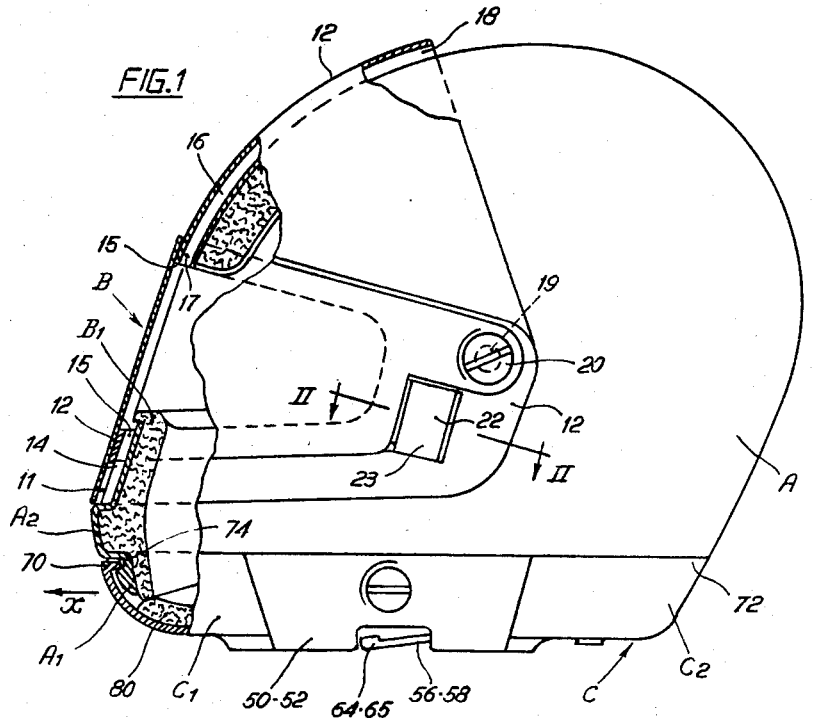
FIG. 1 is a side elevation view of the helmet, with some of its parts shown in cross section
Figure 3:
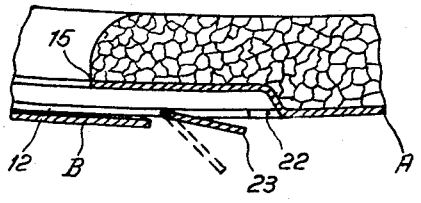
FIG. 3 is a fragmentary section on a larger scale taken on lines III—III of FIG. 1.
Figure 4:
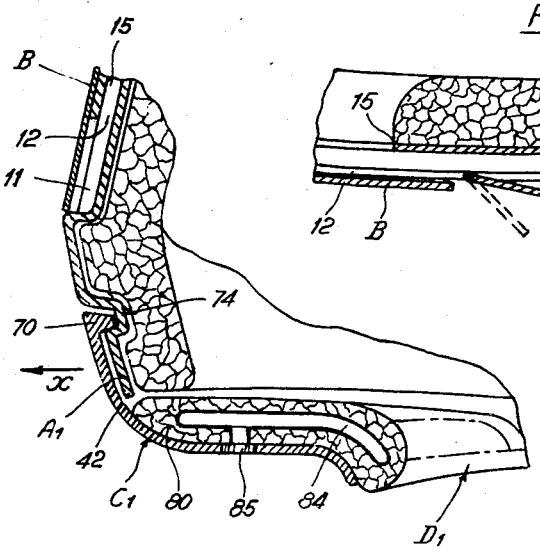

With reference, in particular to FIGS. 1 and 2 of the drawings, letter A identifies the integral body or housing of the helmet, the front opening of which is provided with a movable vizor B. The bottom aperture of helmet body A is delimited by a tapered crown $A_1$ which retains, guides and secures elements $C_1$ and $C_2$ of a collar C apt to secure the helmet on the wearer's head, as will be described hereinafter. Front part $A_2$ of the helmet body A (which delimits the lower part of aperture $B_1$ in vizor B), is provided with a peripheral ledge 10 of suitable height extending over almost the full length of said aperture $B_1$. Said ledge 10 extends horizontally for a certain tract of the front part of body A and its top part is closed by the bottom edge 11 of an arched diaphragm 12 to form a channel 14 the lower aperture of which communicates with the atmosphere and the top one with the interior of the helmet. In the example shown in FIG. 1 lower edge 11 of arched diaphragm 12 is cut to form vertical slots apt to allow passage of air through channel 14. On the other hand, the top opening of said channel forms a slot extending horizontally so as to substantially involve the entire length of vizor B and form, at its outlet an air blade which strikes the internal surface of the vizor, to avoid fogging of the latter.

In the case illustrated in FIG. 1, arched diaphragm 12 is applied to helmet body A so as to substantially involve the entire front surface of the body and is secured to the latter as will be described infra. Diaphragm 12 is provided with an aperture 15 coinciding with aperture $B_1$ for vizor B of the helmet and its rear face is provided with suitably spaced projecting parts to delimit, with outer surface of body A, an interspace 16 the lower and upper apertures 17 and 18 of which, respectively, outlet in the inner and in the proximity of the helmet top. If required, the edge of aperture 15 of arched diaphragm 12 can be provided with a peripheral ledge to house the edge of vizor B, and secure the latter at the level with said diaphragm, while suitable notches are also provided to disengage and lift said vizor.

Arched diaphragm 12 is secured to helmet body A by bushings 19, which consent, if required, removal of said diaphragm for cleaning, and which retain, vizor B by means of pins so as to permit lifting of the latter and free aperture $B_1$. Arched diaphragm 12 may also have parts of its edges contained in the ledges of helmet body A, as will be described thereinafter, with reference to FIG. 7. Arched diaphragm 12 is provided with apertures 22 close to its side ends, suitable shaped to form ejector nozzles so that whenever the helmet is struck by the wind of the running vehicle said apertures aspirate the internal air of the helmet. The aspirating action of apertures 22 can be controlled by associating same with orientable suitably hinged blade 23 to close said apertures more or less.

Again in consideration of FIGS. 1 and 2 of the drawings, collar C shown is double, that is, it is formed by two shaped segments, a front segment $C_1$ and a rear segment $C_2$, operatably coupled to each other. The mid parts of each one of said shaped segments are shaped so as to form cavities which retain paddings $D_1$ and $D_2$, in turn formed so as to adhere to the jaw and head of the user, while the bottom edges of said padded cavities envelop the wearer's neck.

Front segment $C_1$ is provided, at its ends with a pair of tabs 24–25 aligned with the bottom edge of said segment and which extend, by means of appendices 26–27. The top edges of the latter are provided with teeth to form a pair of toothed racks.

In like manner, rear segment $C_2$ is provided with a pair of top tabs 28–29 the elements of which are aligned with the top edge of said segment and terminate with appendices 30–31 whose lower edges are provided with teeth identical and opposite to the teeth of appendices 26–27 of front segment $C_1$.

As it can be seen in FIGS. 2 and 5, the top and bottom edges of the pairs of lower tabs 24–25 and upper tabs 28–29 constitute guiding parts for the pairs of top teeth 30–31 and bottom teeth 26–27. The overlapping elements of said two pairs of teeth 25–27 and 30–31 engage with the associated pinion gears 34–35, retained by perforated pins 38–40, secured to body A of the helmet. Specifically, body A is provided, at the edge of its lower opening, as already stated, with a tapered crown A, the transversal profile of which combines with at least a part of that of shaped segments $C_1$ and $C_2$ so that when the latter are brought close to each other and locked, their peripheral surfaces will be aligned and abut with the periphery of body as it can be noted from the drawings.

Tapered crown $A_1$ is provided with, or forms, at the transversally opposite mid parts, vertical tabs 42 and 44 which securely retain hollow pins 38–40 associated with pinions 34–36 and which may be conveniently shaped to meet specific requirements.

Pinions 34 and 36 are retained axially and rotatably to their relevant perforated pins 38–40 by screws 46 and 48 engaging in the threaded holes of pins 38–40 while the heads of said screws are housed in recesses in the required positions in cover plates 50–52, thereby to retain and guide the two pairs of teeth 26–27 and 30–31 hence also the two shaped segments $C_1$ and $C_2$. Cover plates 50 and 52 are so shaped that their outer faces are perfectly co-planar and abut with the outer surface of helmet A. In order to improve retention and guidance of shaped segments $C_1$ and $C_2$ in the inner surfaces of each cover plate 50–52 are provided with one or more pairs of slots (or projecting parts) 54–55 the elements of which are horizontal, parallel and opposite with respect to the axis of related pinion 34 (36). This pair of slots houses, slidably, one or more pairs of projecting parts (or slots) 56–57, the elements of which extend longitudinally along each one of the tabs of the lower pair of tabs 24–25 and upper pair 28–29 of rear and front segments $C_1$ and $C_2$ respectively. In this manner, said segments are further guided horizontally when shifting in opposite directions and said guide elements are carried by tapered crown $A_1$ i.e. by parts integral with body A of the helmet.

Each one of cover plates 50–52 is provided, on its lower part, in the proximity of its middle part, with an aperture 58 which, by interrupting the lower overturned edge 60, forms a stop piece for respective segment $C_1$–$C_2$. The pair of toothed appendices 26–27 (and if necessary also the pair of toothed appendices 30–31) is provided with a pair of sprung teeth 64–65 the ends of which engage, head to head, the stop pieces 60 of cover plates 50–52 to retain the two segments $C_1$ and $C_2$ in the retracted or closed position. The pairs of lower tabs 24–25 and upper pins 28–29, are provided in opposite positions with projecting parts 66–68 which by coming into engagement with counter projections (not shown) in the internal faces of cover plates 50–52 constitute limit stops for shaped segments $C_1$–$C_2$ when the latter are shifted to their maximum open position.

The stops just considered for shaped segments $C_1$ and $C_2$ in particular, stops 64–65, can be provided with adjustable means apt to permit adaptation of paddings $D_1$ and $D_2$, provided in said segments to, the jaw, neck and head of the wearer.

Retention of segments $C_1$ and $C_2$ in the closed or retracted position to body A of the helmet is ensured, under all aspects, in that the vertical walls of the cavities of said segments which house paddings $D_1$ and $D_2$ are fitted with horizontal projections 70–72 (or slots) at the coupling point of the junction zone between tapered crown $A_1$ and the bottom end of helmet body A. Horizontal slots 74 and 75 extend from the mid front and rear parts of crown $A_1$ up to a point close to vertical tabs 42 and 44. In this manner, when shaped segments $C_1$ and $C_2$ are closed on the neck of the user they are firmly secured to body A of the helmet, which is thus closely fitted on the wearer's head.

The introduction and removal of the helmet on the body are performed by quick and simple operations. Specifically, the wearer acts simultaneously on sprung teeth 64–65 to disengage the ends of stops 60 thereby exerting either one of two shaped segments $C_1$ and $C_2$ (preferably on front segment $C_1$) a pulling action in the direction of arrow X (FIGS. 1 and 2). Therefore, the pairs of pinions 35–36 is caused to rotate to shift horizontally the pair of toothed racks 30–31; consequently rear segment $C_2$ is caused to shift in a direction opposite so that of front segment $C_1$ to free the bottom aperture of the helmet which may thus be removed from the wearer's head.

Application of the helmet is effected with similar and even simpler operations; that is, the wearer inserts the helmet and presses front segment $C_1$ in a direction opposite to arrow X until the two segments $C_1$ and $C_2$ forming collar C secure the helmet; this operation is also assisted by the automatic action of the spring elastic stops 64–65 which secure said segments to the helmet.

As we have already illustrated, front segment $C_1$ and rear segment $C_2$ are shaped so as to have in their mid parts some angular recesses to retain and hold paddings $D_1$ and $D_2$. To ensure a proper fit of paddings $D_1$ and $D_2$ to the jaw, head and neck of the wearer, these consist of shaped pads 80–82 each formed by two or more layers of cellular shaped soft resilient material, the bottom one with closed cells and the other, close to the wearer's skin, with open cells. The pads are suitably secured to the walls of the cavities of shaped segments $C_1$ and $C_2$ and are provided with adequate lining. In order to obtain optimum adaptability of paddings $D_1$ and $D_2$ to the wearer's chin and neck, pads 80 and 82 are combined with resistant bladders 84–86, provided with relevant incorporated valves 85–87, conveniently located on shaped segments $C_1$ and $C_2$ in positions that will be easily accessible to the user for controlled inflation of said bladders.

As already stated, a part of the edges of arched screen 12 may be housed in relevant ledges in body A of the helmet. This is shown in FIG. 7 where parts of the helmet equal to those just now considered are identified with the same reference symbols. In the figure, the height of arched screen 12 is lower, so that its edges may engage in a peripheral recess 88 adjacent to opening $B_1$ of the helmet. Evidently arched screen 12 is always provided at its side ends with tapered openings 22 through which the air inside the helmet may be discharged to the exterior.

Figure 8:
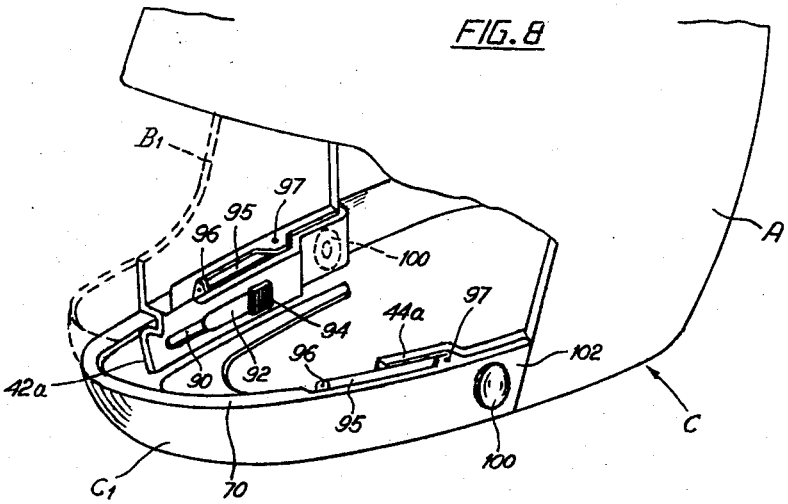
Figure 9:
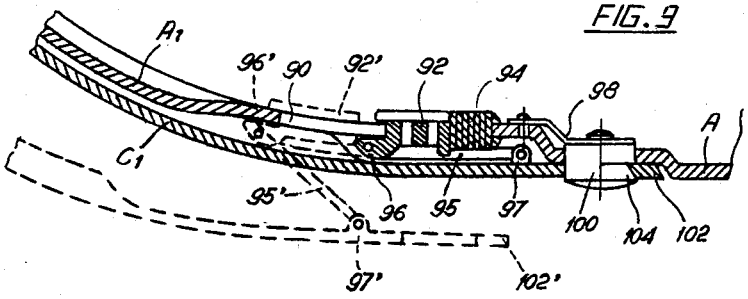
FIG. 9 is a detail in horizontal cross section of the helmet collar shown in FIG. 8

FIGS. 8 and 9 of the drawings illustrated a variant of embodiment of collar C of the helmet, in which front segment $C_1$ of the collar is movable horizontally by means of hinged elements. In these figures parts equal or equivalent to those of FIGS. 1 to 6 are identified with the same reference symbols.

Tapered crown $A_1$ of the helmet is provided, also in this case, with vertical fins 42*a*, 44*a* each of which is in turn provided with a longitudinal slot 90 in which is guided, slidably, a slider 92.

The rear end of said slot retains an elastic element 94 consisting of a shaped bearing to actuate said slider 92, as will be described hereinafter.

A connecting rod 95 is coupled pivotably, at one of its ends 96, with slider 92 while the other end 97 is connected movably with perforated fins secured to the respective ends of front segment $C_1$ to from between the latter and helmet body A a pair of double hinges apt to shift, retain and guide, during its horizontal movement.

Each one of vertical fins 42*a* and 44*a* retain securely, toward their rear ends a leaf spring 98, the free end of which is connected to a shaped projecting part or control button 100. Button 100 slides guided in a hole provided in a suitable position of its respective vertical fin 42*a* and 44*a*, and apt to retain securely said projection 100.

Front segment $C_1$ is provided, at its ends, with perforated fins 102 in which engages end 104 of respective button 100, suitably shaped for the purpose specifically, end 100 exerts on the end considered of segment $C_1$ a pulling action opposite to that exerted on slider 92 by elastic bearing 94, to retain said shaped segment $C_1$ in its retracted position, that is, in engagement with tapered crown $A_1$ of helmet A.

It follows that the wearer, by actuating buttons 100 disengages shaped ends 104 of the latter from the holes in tabs 102, thereby freeing front segment $C_1$ of tapered crown $A_1$ from the helmet. Said disengagement of segment $C_1$ can be facilitated by the action of sprung means which, by acting on said front segment $C_1$ bring the latter in the position shown in FIG. 9 by a dotted line. When the segment is returned to its closed position, perforated find 102 engage with sprung buttons 100 to maintain centered shaped segment $C_1$ in opposition to the action of resilient pads 94.

The variant of the helmet just now considered affords the advantage, with respect to that previously considered, to provide a wider opening in the lower aperture of the helmet as the lateral ends 102 of front segment $C_1$ in their return movement while shifting sidewise move away from each other, as illustrated in FIG. 9 already considered. Obviously, and if required the double hinge system just considered may be applied also to make movable rear segment $C_2$ of the helmet.

FIG. 10 illustrates a helmet with collar C of the type considered in FIGS. 1 and 2, that is, with front segment $C_1$ apt to move in a rectilinear direction. In this further variant vertical fins 42*b* and 44*b* of body A retain guided the first 104 of two sets of telescope element 108 of said sets is integral with the relevent end 102*b* of segment $C_1$ to guide the latter in its rectilinear movements which are limited by the stops in the telescope elements. In this variant buttons 100*b* engage telescope elements 106 and 108 when these are in their retracted position to retain segment $C_1$ in closed position. After what stated in relation to the figures of the drawings the objects of this invention are confirmed, that is, the rational and comfortable retention of the helmet on the wearer's head, assuring at the same time and constantly ventilation and aeration of the interior of the helmet avoiding also fogging of vizor B.

It must be noted that no discomfort or obstacle can derive to the wearer from the use of the helmet according to the invention, as this is secured on the head so as to house this fully and surround the neck rationally without creating any whatsoever discomfort to the wearer. The interior of the helmet on the other hand, as already stated, is constantly aerated and ventilated due to the presence of the apertures: front aperture 10 and side aperture 22 and, in the case of FIG. 1 also a summit aperture 18, all of which apertures connect the interior of the helmet with the exterior. Moreover, ventilation is improved further by the wind produced by the running vehicle which strikes the helmet.

In relation to the characteristics of the helmet described in conjunction with the fingers and drawings, some of these characteristics can be adopted and applied also to known helmets of specific type. For example, the aeration and ventilation system for the interior of the helmet can be adopted and applied also the usual types of helmets, especially those with a type of collar that may be opened.

Although a preferred form of embodiment of the helmet according to the invention has be described, modifications and variants may be introduced in the helmet to meet specific requirements and end uses. For example, pinions 34 and 36 may be provided with push buttons for control; said pinions may also be secured operatively with a suitable acutating motor, for example, an electric or fluo dynamic motor. Similarly, sprung teeth 64 and 65 may be located in cover plates 50–52 to engage relevant stops 60 in tabs 24–25 and 28–29. Said teeth may be associated with push-buttons for their disengagement from stops 60, to permit simultaneous horizontal movements of the shaped segments of collar C. Said shaped segments may be provided with or combined with sprung means the action of which is developed to shift and maintain the segments in one of their extreme positions. For example, the sprung means may be retained at their ends, by tabs 24–28 and 25–29 to move segments $C_1$ and $C_2$ away from each other.

It is understood that the above and other varients may be introduced, without departing from the domain of the invention.

I claim:

1. A protective helmet arrangement for protection of the head of the wearer, comprising an upper part;

a rear lower part being permanently attached to said upper part, said rear lower part having a first engaging member being positioned in such a manner that a substantial portion of the first engaging member is extended beyond said rear lower part, at least one surface of said first engaging member having an engaging area adapted for close engagement with engaging means of the arrangement;

a front lower part, having an inside area which is adapted to face a lower portion of the face of the wearer, said front lower portion having a second engaging member being positioned in a such manner that a substantial portion of the second engaging member is extended beyond said first lower part, at least one surface of said second engaging member having an engaging area adapted for close engagement with the engaging means;

said engaging means being rotatably positioned between said engaging areas of said first and second engaging members, an axis of rotation of said engaging means being permanently positioned within said protective helmet, an outside contour of said engaging means being shaped for close engagement with said engaging areas;

receiving means of said helmet arrangement being adapted to slidably receive said first and second engaging members in assembled condition thereof and to accommodate said axis of rotation of said engaging means; and locking means being designed to lock said front lower part in a predetermined position thereof relative to said upper part and rear lower part of said helmet arrangement.

2. An arrangement according to claim 1 wherein said engaging means is a gear.

3. An arrangement according to claim 2 wherein said engaging areas of said first and second engaging members have a plurality of teeth for engagement with said gear.

4. An arrangement according to claim 1 wherein said first engaging member is extended beyond both ends of said rear lower part and said second engaging member is extended beyond both ends of said front lower part.

5. An arrangement according to claim 1 wherein said engaging areas are positioned on a lower part of said first engaging member and on an upper part of said second engaging members correspondingly.

6. An arrangement according to claim 1 wherein said engaging areas are positioned on an upper part of said first engaging member and on a lower part of said second engaging member correspondingly.

7. An arrangement according to claim 1 wherein said locking means is designed to stop rotation of said engaging means.

8. An arrrangement according to claim 1 wherein said engaging means is rotated by movement of said engaging areas during adjustment of the position of said front lower part within the helmet.

* * * * *